US005098654A

United States Patent [19]

Wenschot

[11] Patent Number: 5,098,654

[45] Date of Patent: Mar. 24, 1992

[54] ALLOY BASED ON COPPER, MANGANESE AND ALUMINUM, AND OBJECTS MADE OF SAID ALLOY

[75] Inventor: Petrus Wenschot, Oisterwijk, Netherlands

[73] Assignee: Boliden LDM Nederland B.V., Drunen, Netherlands

[21] Appl. No.: 635,311

[22] Filed: Jan. 3, 1991

[30] Foreign Application Priority Data

Jan. 4, 1990 [NL] Netherlands ..... 9000019

[51] Int. Cl.[5] ..... C22C 9/05; C22C 22/00

[52] U.S. Cl. ..... 420/434; 420/479; 420/486; 420/582

[58] Field of Search ..... 420/434, 474, 480, 486, 420/487, 582

[56] References Cited

U.S. PATENT DOCUMENTS 4,818,307 4/1989 Mori et al. ..... 420/486

FOREIGN PATENT DOCUMENTS 234174 3/1986 German Democratic Rep. ..... 420/479

*Primary Examiner*—R. Dean
*Assistant Examiner*—George Wyszomierski
*Attorney, Agent, or Firm*—Cushman, Darby & Cushman

[57] ABSTRACT

An alloy based on copper, manganese and aluminum, said alloy further containing iron and nickel, besides unavoidable impurities, with less than 7% by weight zinc and possible other metals, which alloy is formed of 10–55% by weight manganese, 4–10% by weight aluminum, 0.5–5% by weight iron, 2–8% by weight nickel and 0.5–2.5% by weight titanium, the balance being copper.

5 Claims, No Drawings

ALLOY BASED ON COPPER, MANGANESE AND ALUMINUM, AND OBJECTS MADE OF SAID ALLOY

The invention relates to an alloy based on copper, manganese and aluminum, said alloy further containing iron and nickel besides unavoidable impurities, with less than 7% by weight zinc and possible other metals. The invention furthermore relates to objects made of such alloys.

Such an alloy is known from Dutch Patent No. 124,966, said known alloy besides copper containing 1–9% iron, 0–7% nickel, 3–9% aluminum and 10–16% manganese. It has become apparent that the mechanical properties of said alloy, in particular its embrittlement, can be improved, so that it is possible to make objects of said alloys, at lower temperatures than have been usual so far.

From German Patent Specification 343,739 an alloy of copper, zinc and manganese is known which may contain up to 33% zinc, to which the elements aluminum, nickel, manganese and titanium are added. A specially mentioned example of such an alloy contains 61% copper, 10.7% manganese, 2.3% iron, 0.37% nickel, 3.6% aluminum, 0.5% titanium, the balance being zinc. The resistance to corrosion of said zinc-containing alloy is comparatively poor.

Also from British Patent Specification 727,021 a copper-manganese-aluminum alloy is known that contains 10–15% manganese, 6.5–9% aluminum, 2–4% iron and 1.5–6% nickel the balance being copper. Such an alloy is also known as an aluminum bronze alloy and also with this alloy it appeared to be possible to improve the embrittlement, so that objects can be formed of said alloys at lower temperatures.

The alloy according to the invention is characterized in that it contains 10–55% by weight manganese, 4–10% by weight aluminum, 0.5–5% by weight iron, 2–8% by weight nickel and 0.5–2.5% by weight titanium, the balance being copper. Preferably the titanium content is at least equal to half the iron content, and the nickel content is higher than the iron content. Furthermore aluminum may be partially replaced by zinc maximally by 7% by weight zinc.

Two preferable embodiments of the present invention include:

1) an alloy which contains 5–8% by weight aluminum, 11–25% by weight manganese, 0.5–3% by weight iron, 2–6% by weight nickel, 0.5–2% by weight titanium, 0–5% by weight zinc, with the balance being copper and impurities not exceeding 0.5% by weight, and 2) an alloy which contains 4–6% by weight aluminum, 45–55% by weight manganese, 0.5 to 3% by weight iron, 2–6% by weight nickel, 0.5–2% by weight titanium, 0–5% by weight zinc, with the balance being copper and impurities not exceeding 0.5% by weight.

From an article by S. W. Frost et al: "Thermal embrittlement in an Mn-Ni-Al bronze Casting Alloy", AFS Transactions, vol.146, pages 653–659 (1980) it is known that with copper-manganese-aluminum alloys signs of embrittlement may occur, leading to premature fracture, especially with dynamically loaded parts in corrosion causing environments, as a result of which objects made of said alloys are less suitable for use in corrosive conditions. These signs of embrittlement are considerably reduced when objects are made of the alloy according to the invention.

Because of the presence of titanium in manganese- and aluminum-containing copper alloys the resistance to corrosion and oxidation and the corrosion fatigue properties are at the same time considerably improved. Objects made of the new alloy have a very high resistance to wear, good mechanical properties and a high damping force when the manganese content is higher than 45% by weight.

By adding titanium to the manganese- and aluminum-containing copper alloys the precipitation of an impure, brittle phase in the structure of the material during cooling may be prevented. The occurrence of the impure, brittle phase in the structure, and the effect on the properties of the material is indicated in more detail in the following Tables A en B.

It has been determined that dependent on the composition and cooling rate of the material a manganese-rich phase of the type Mn($\beta$) is precipitated. Mn ($\beta$) is an allotropic modification of the element manganese with a complex, cubic structure, which occurs at high temperatures in the manganese-rich part of the system copper-manganese. With copper-manganese alloys Mn ($\beta$) does not occur before a complete state of equilibrium is reached, with very slow cooling of the material.

The addition of small amounts of aluminum and/or zinc and large amounts of iron and nickel has a stabilizing effect on the formation of Mn ($\beta$). Thus a phase of the type Mn ($\beta$) already occurs with slow cooling of a manganese- and aluminum-containing copper alloy containing more than 13% by weight manganese and 6% by weight aluminum, to which a maximum amount of 5% by weight iron and nickel is added.

This phase of the type Mn ($\beta$) is formed as a result of the interaction of aluminum, iron and manganese, which elements are precipitated during cooling, as a result of oversaturation of the solution area. When the local concentrations of iron, manganese and aluminum are exceeded a brittle phase of the type Mn ($\beta$) is formed, which contains more than 60% by weight manganese, and which greatly affects the properties of the alloys, especially after relatively slow cooling, being lower than 250° C./hour.

The presence of iron and nickel in the manganese- and aluminum-containing copper alloys is essential in connection with the strength and corrosion properties of the material.

As a result of the addition of the indicated amount of titanium to the manganese- and aluminum-containing copper alloy, also containing iron and nickel, there will be no precipitation of a brittle phase of the type Mn ($\beta$).

The presence of titanium in the alloy causes the formation of a separate, ductile phase with iron, nickel, aluminum and maximally 10% by weight manganese, which provides a considerable improvement of the properties of the alloy.

For this purpose it is necessary that the elements titanium, iron and nickel are present in certain amounts and preferably in a certain ratio. In that case the titanium content is at least equal to half the iron content, in order to effect the formation of a separate, ductile phase.

The nickel content is preferably higher than the iron content, in order to be able to offset the amount of nickel extracted from the matrix as a result of the occurrence of said phase.

Besides the above-mentioned elements the alloy may also contain a certain amount of zinc. This makes it possible for the alloy to be melted in an oven in which previously brass was present. Thus an easy changeover is possible from aluminum bronze, via the alloy in question, to brass, and vice versa. In case zinc is present in the alloy an aluminum equivalent of about 0.3% must be taken into account.

The alloys according to the invention are suitable for producing objects by heat-moulding processes. The heat-moulding temperatures are on average 100° C. lower than with the known nickel-aluminum bronze alloys having comparable properties.

Within the composition range of the alloy according to the invention a number of test pieces were cast and cooled at varying rates. Various mechanical properties of said test pieces were measured, which were compared with similar alloys to which no titanium was added, and which were cooled under similar conditions. The results are shown in Table A, wherein the alloys 1, 2, 7, 12 and 13 are comparative alloys. From this Table it follows that the titanium-containing alloys have a higher elongation than the alloys that do not contain titanium, which indicates that titanium-containing alloys are not brittle by nature, compared with the alloys that do not contain titanium.

In Table A the alloy 18 has a high manganese content. Said alloy has a high specific damping capacity of 15-20%. The alloy 14 on the contrary has a specific damping capacity of about 3%. The corrosion resistance properties of a number of these alloys, cooled at a rate of 40° C./hour, were measured, Said properties are indicated by the number of reversals until fracture occurs at a given load condition of a test bar in a 3% sodium chloride solution. The results are shown in Table B. From this table it can be derived that with dynamic loads in a corrosive environment the life of titanium-containing alloys (alloys 20 and 21) is considerably longer than in the case of alloys that do not contain titanium (alloy 19).

TABLE A

| cooling rate °C./uur | number of the alloy | composition in weight % Cu | Al | Mn | Fe | Ni | Zn | Ti | mechanical properties: tensile strength RM N/mm² | 0.2% yield strength Rp N/mm² | elongation A5 % | hardness HB |
|---|---|---|---|---|---|---|---|---|---|---|---|---|
| 250 | 1 | 68.5 | 6.1 | 19.2 | 1.0 | 2.1 | 3.1 | — | 686 | 418 | 8 | 222 |
| | 2 | 66.5 | 6.1 | 20.6 | 1.0 | 2.6 | 3.2 | — | 820 | 430 | 5 | 239 |
| | 3 | 67.0 | 5.9 | 19.7 | 0.9 | 2.4 | 3.1 | 1.0 | 760 | 426 | 19 | 204 |
| | 4 | 71.5 | 6.5 | 17.8 | 1.0 | 2.1 | — | 1.1 | 650 | 338 | 24 | 166 |
| | 5 | 67.7 | 6.8 | 19.4 | 2.0 | 3.1 | — | 1.0 | 742 | 376 | 18 | 198 |
| | 6 | 66.1 | 6.8 | 19.1 | 2.0 | 5.0 | — | 1.0 | 737 | 365 | 17 | 201 |
| 40 | 7 | 66.5 | 6.1 | 20.6 | 1.0 | 2.6 | 3.2 | — | 663 | 347 | 7 | 208 |
| | 8 | 67.0 | 5.9 | 19.7 | 0.9 | 2.4 | 3.1 | 1.0 | 702 | 326 | 25 | 185 |
| | 9 | 69.7 | 6.6 | 17.7 | 1.0 | 4.0 | — | 1.0 | 621 | 261 | 29 | 156 |
| | 10 | 67.7 | 6.8 | 19.4 | 2.0 | 3.1 | — | 1.0 | 672 | 322 | 20 | 171 |
| | 11 | 66.1 | 6.8 | 19.1 | 2.0 | 5.0 | — | 1.0 | 669 | 315 | 18 | 176 |
| 12 | 12 | 70.2 | 6.7 | 19.5 | 1.1 | 2.0 | 0.5 | — | 591 | 338 | 11 | 179 |
| | 13 | 66.9 | 6.0 | 18.9 | 2.0 | 3.1 | 3.1 | — | 620 | 287 | 12 | 179 |
| | 14 | 70.7 | 6.8 | 19.0 | 1.0 | 2.0 | — | 0.5 | 650 | 341 | 22 | 176 |
| | 15 | 71.7 | 6.5 | 17.8 | 1.0 | 2.0 | — | 1.0 | 585 | 279 | 29 | 147 |
| | 16 | 69.7 | 6.6 | 17.7 | 1.0 | 4.0 | — | 1.0 | 583 | 235 | 30 | 147 |
| | 17 | 65.8 | 6.8 | 19.4 | 2.0 | 5.0 | — | 1.0 | 637 | 279 | 23 | 175 |
| | 18 | 42.2 | 4.5 | 49.7 | 1.1 | 2.0 | — | 0.5 | 585 | 321 | 18 | — |

TABLE B

| number of the alloy | composition weight % Cu | Al | Mn | Fe | Ni | Zn | Ti | Sm N/mm² | Sa N/mm² | number of reversals ΔNf*10⁶ |
|---|---|---|---|---|---|---|---|---|---|---|
| 19 | 71.5 | 7.3 | 13.8 | 3.1 | 2.0 | 2.3 | — | 0 | 127.5 | 7.5 |
| | | | | | | | | 0 | 127.5 | 6.8 |
| | | | | | | | | 70 | 70 | 45 |
| | | | | | | | | 80 | 80 | 18.4 |
| 20 | 73.4 | 6.9 | 13.2 | 0.9 | 3.0 | 1.8 | 0.8 | 0 | 127.5 | 37.1 |
| | | | | | | | | 0 | 127.5 | 45.0 |
| | | | | | | | | 70 | 70 | 492 |
| 21 | 75.6 | 7.0 | 12.4 | 1.0 | 2.9 | 0.4 | 0.7 | 70 | 70 | 234.3 |
| | | | | | | | | 80 | 80 | 101.5 |
| | | | | | | | | 140 | 60 | 100.4 |
| | | | | | | | | 140 | 60 | 130 |

Remark:
Sm = mean stressvalue
Sa = amplitude alternating stress
ΔNf = number of reversals in a solution of 3% sodium chloride will fracture.

I claim:

1. An alloy based on copper, manganese and aluminum, iron and nickel, besides unavoidable impurities, characterized in that said alloy consists essentially of 11-55% by weight maganese, 4-10% by weight aluminum, 0.5-3.5% by weight iron, 2-8% by weight nickel and 0.5-2.5% by weight titanium, the balance being copper.

2. An alloy according to claim 1, wherein the titanium content is at least equal to half the iron content, and the nickel content is higher than the iron content.

3. An alloy according to claim 1, wherein a portion of the aluminum in the alloy may be replaced by zinc to a maximum of 7% by weight of zinc.

4. An alloy according to claim 1, wherein the alloy consists essentially of 5-8% by weight aluminum, 11-25% by weight manganese, 0.5-3% by weight iron, 2-6% by weight nickel, 0.5-2% by weight titanium, 0–5% by weight zinc, the balance being copper, with the amount of impurities not exceeding 0.5% by weight.

5. An alloy according to claim 1, wherein the alloy consists essentially of 4–6% by weight aluminum, 45–55% by weight manganese, 0.5–3% by weight iron, 2–6% by weight nickel, 0.5–2% by weight titanium, 0–5% by weight zinc, the balance being copper with the amount of impurities not exceeding 0.5% by weight.

* * * * *